US005139462A

United States Patent [19]

Gabe

[11] Patent Number: 5,139,462

[45] Date of Patent: Aug. 18, 1992

[54] AUTOMATED SWING

[76] Inventor: Curtis Gabe, 2721 E. Eaton La., Cudahy, Wis. 53110-2817

[21] Appl. No.: 764,712

[22] Filed: Sep. 24, 1991

[51] Int. Cl.[5] ..... A63G 9/16

[52] U.S. Cl. ..... 472/119; 5/109

[58] Field of Search ..... 472/119, 125; 297/273-277; 5/108, 109

[56] References Cited

U.S. PATENT DOCUMENTS

| | | |
|---|---|---|
| 49,465 | 8/1865 | Wolfinger . |
| 2,274,310 | 2/1942 | Walter . |
| 2,564,547 | 8/1951 | Schrougham . |
| 2,609,031 | 9/1952 | Puscas . |
| 3,146,985 | 9/1964 | Grudoski . |
| 4,165,872 | 8/1979 | Saint . |
| 4,448,410 | 5/1984 | Kosoff . |
| 4,697,845 | 10/1987 | Kamman . |

*Primary Examiner*—Richard E. Chilcot, Jr.

*Attorney, Agent, or Firm*—Andrus, Sceales, Starke & Sawall

[57] ABSTRACT

An automated swing includes a support frame assembly and a swinging frame assembly pivotally mounted to the support frame assembly. A seat is carried by the swinging frame assembly, and a swinging drive mechanism is interposed between the support frame assembly and the swinging frame assembly. The swinging drive mechanism includes a pair of resilient belts. Each belt is driven by an elliptical pulley mounted to a rotating drive shaft, with each belt being engageable with the swinging frame assembly. Upon rotation of the elliptical pulleys in response to rotation of the drive shaft, the belts pull the swinging frame assembly in one direction, with tension being introduced into the belts. Continued rotation of the elliptical pulleys releases tension in the belts, to allow the swinging frame assembly to swing in the other direction. The resiliency of the belts provides smooth transition between forward and rearward movement of the swinging frame assembly, to provide a smooth and comfortable swinging motion.

13 Claims, 2 Drawing Sheets

FIG. 3
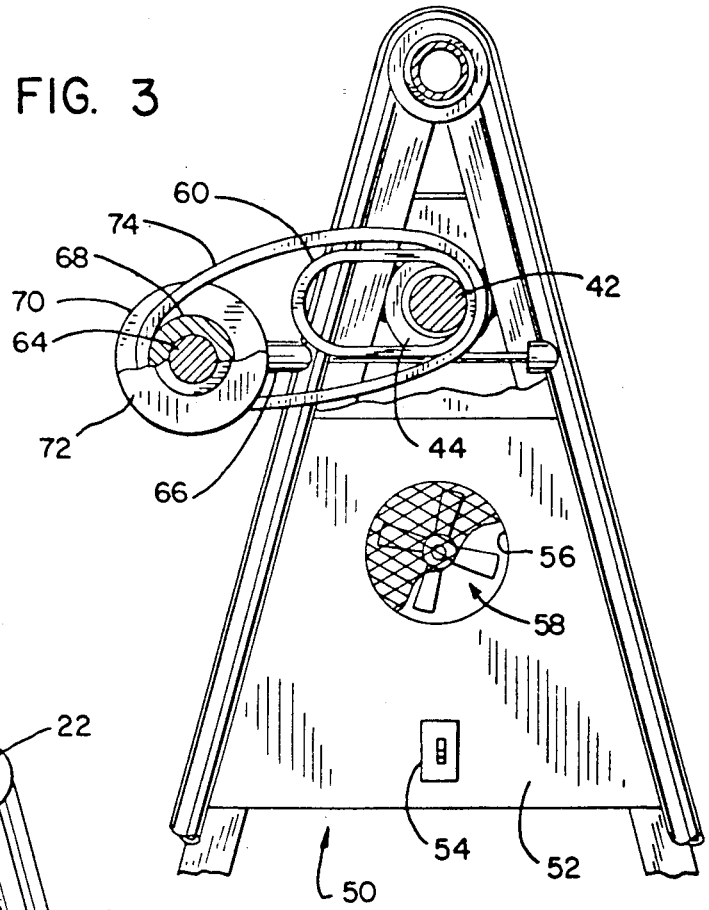
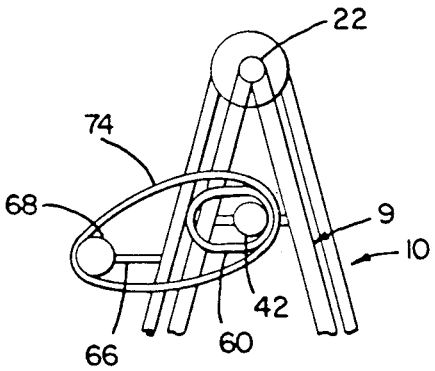
FIG. 4
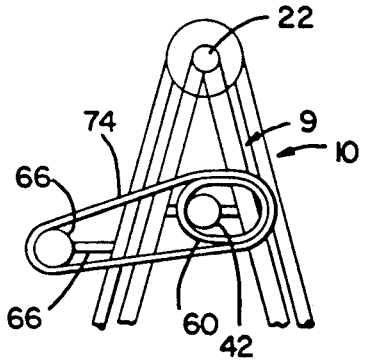
FIG. 5
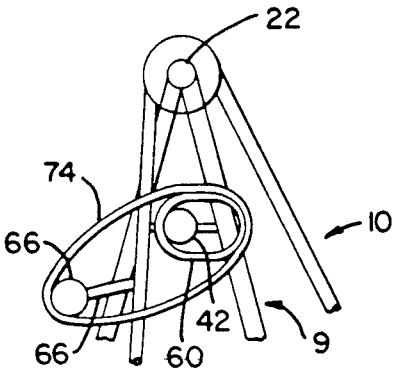
FIG. 6

AUTOMATED SWING

BACKGROUND OF THE INVENTION

This invention relates to a swing, and more particularly to an improved drive system for moving the swing in a back and forth manner.

A swing generally consists of a stationary support frame to which a swinging frame is pivotally mounted. A seat or chair is mounted to the swinging frame, and is suspended by the swinging frame from the stationary support frame. To swing the seat or chair, it is known to provide a swinging drive arrangement to move the swinging frame in a back and forth manner. With mechanical drives as are known in the prior art, however, the swinging action is somewhat jerky when the swing reaches its forwardmost or rearwardmost swinging positions, during transition of the swinging frame movement from one direction to another. This characteristic is undesirable in that the occupant of the seat or chair is subjected to the jerkiness imparted to the swinging frame, resulting in the occupant's swinging experience being less than satisfactory.

Automated swings of the type described above are commonly used by parents to swing an infant. In addition, another market for automated swings of this type is elderly people, who are generally known to enjoy the back and forth movement offered by a rocking chair or a gliding chair.

It is an object of the present invention to provide an automated swing with an improved swing drive arrangement, for use with any type of swing in which a swinging frame is mounted for pivoting movement to a support frame. It is a further object of the invention to provide a swing drive arrangement which imparts a smooth and even swinging motion to the swinging frame, to eliminate jerkiness involved in transition of the swinging frame from movement in one direction to movement in the other direction. It is yet another object of the invention to provide such a swing drive arrangement which is simple in its construction and operation, yet which is highly satisfactory in imparting swinging motion to the swinging frame.

In accordance with the invention, a drive arrangement is interposed between the support frame and the swinging frame of an automated swing for pivoting the swinging frame relative to the support frame. The drive arrangement includes a resilient member engageable with the swinging frame assembly, and a reciprocable mechanism acting on the resilient member for intermittently tensioning the resilient member to engage the swinging frame assembly to pull it in a first direction, and releasing tension on the resilient member to allow the swinging frame assembly to return in a second direction. The resilient member may be a drive belt constructed of a resilient material. A rotatable element is provided on the swinging frame, and the drive belt is trained about the rotatable element. The rotatable element may take the form of a bearing member engageable with a shaft mounted to the swinging frame. The shaft is mounted off-center of the swinging frame. The reciprocable mechanism may take the form of a rotatable drive shaft, a rotary power source for imparting rotation to the drive shaft, and an eccentric drive member mounted to the drive shaft and engageable with the drive belt. The eccentric drive member is preferably an elliptical member mounted to the drive shaft, with the drive shaft extending through the elliptical member and being mounted thereto such that the center of the drive shaft is coincident with the major axis of the elliptical member. With this arrangement, rotation of the drive shaft results in the elliptical member intermittently tensioning the drive belt and releasing tension on the drive belt. When the drive belt is tensioned, it stretches while pulling the swinging frame in one direction. When tension on the drive belt is relieved, the weight of the swinging frame, the seat or chair, and its occupant results in movement of the swinging frame assembly in the opposite direction. Subsequent re-tensioning of the drive belt upon further rotation of the elliptical member again pulls the swinging frame assembly in the first direction, until tension on the belt is once again relieved after further rotation of the drive shaft and the elliptical member. Continued rotation of the drive shaft results in a repeated back and forth swinging motion being imparted to the swinging frame, and thereby to the seat or chair and its occupant.

In a particularly preferred form of the invention, the swinging frame comprises frame members located one on either side of the seat or chair. A drive belt and an elliptical drive member are located one adjacent each of the pair of frame members.

The invention further contemplates a method of pivoting the swinging frame relative to the support frame to swing the chair, substantially in accordance with the foregoing summary.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 3 is an enlarged partial section view, taken along line 3—3 of FIG. 1; and FIGS. 4–6 schematically illustrate the drive arrangement in varying positions for imparting back and forth movement to the swinging frame.

DETAILED DESCRIPTION OF THE PREFERRED EMBODIMENT

Figure 1:
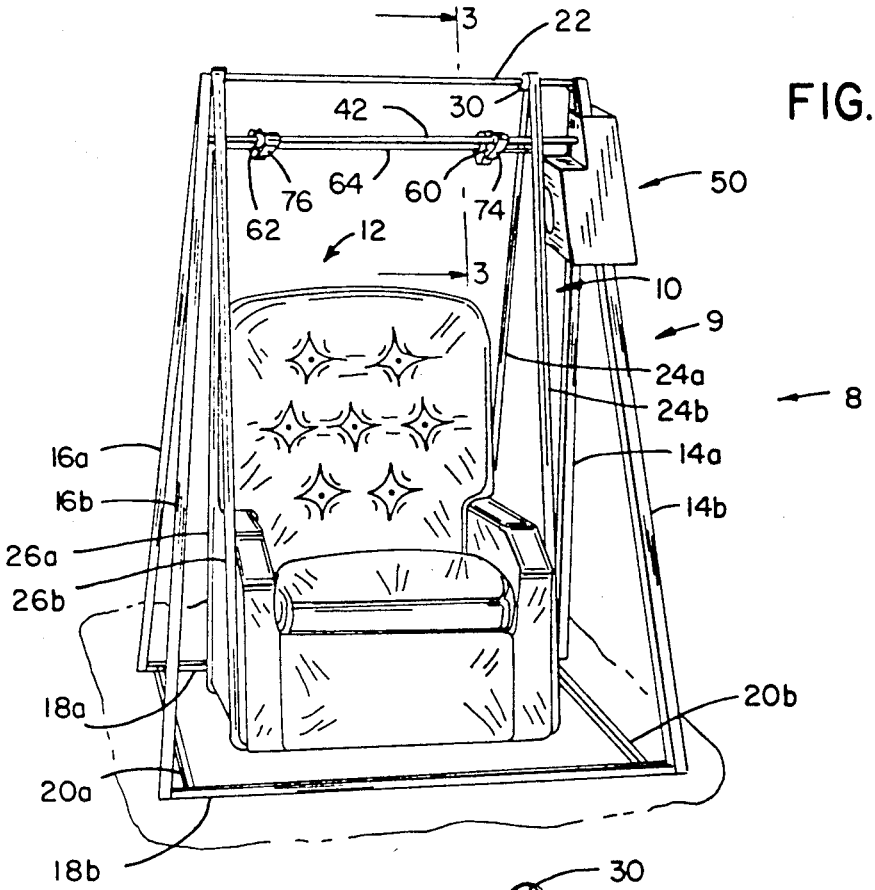
FIG. 1 is an isometric view of an automated swing constructed according to the invention.

FIG. 1 shows a free-standing swing 8 which generally consists of an outer stationary support frame 9, an inner swinging frame 10 mounted for pivoting movement to support frame 9, a drive mechanism interposed between the support frame and the swinging frame, and a seat or chair in the form of a recliner 12 suspended from the swinging frame.

The outer support frame 9 consists of a pair of frame members 14*a* and 14*b* on one side, a pair of frame members 16*a* and 16*b* on the other side, and a pair of cross-members 18*a* and 18*b* extending between the lower ends of frame members 14*a*, 16*a* and 14*b*, 16*b*, respectively. A pair of brace members 20*a* and 20*b* extend between and are connected to cross-members 18*a* and 18*b*.

Frame members 14*a* and 14*b* terminate in an upper apex, as do frame members 16*a* and 16*b*. A cross-shaft 22 extends between the upper end of frame members 14*a*, 14*b* and 16*a*, 16*b*, at the apices formed by the frame members. Cross-shaft 22 is rigidly fixed to frame members 14a, 14b and 16a, 16b in any satisfactory manner, such as by welding or the like.

Figure 2:
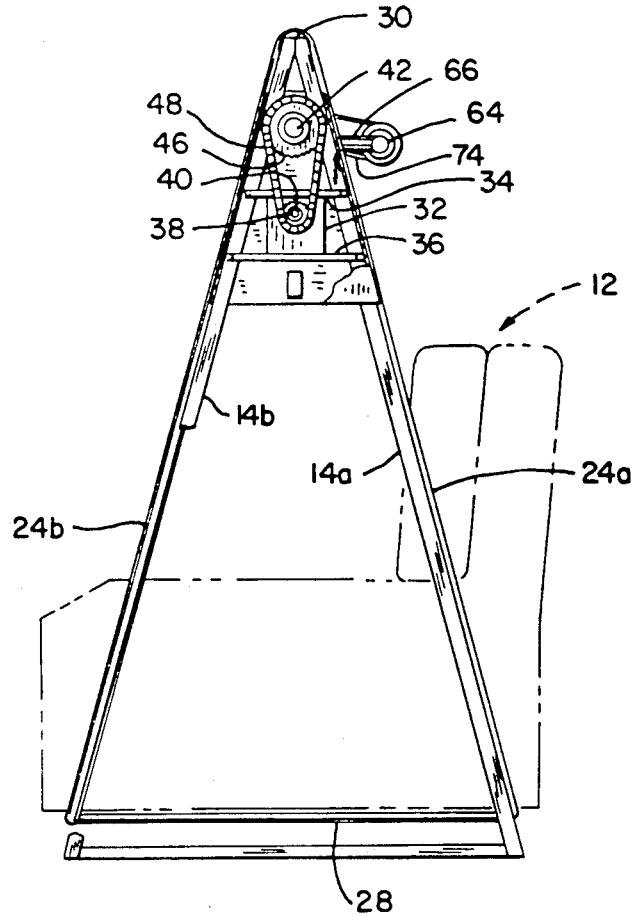
FIG. 2 is a side elevation view of the automated swing of FIG. 1.

The inner swinging frame assembly 10 consists of a pair of legs 24a, 24b located adjacent support frame members 14a, 14b, and a pair or legs 26a, 26b located adjacent support frame members 16a, 16b. A lower cross-member (not shown) extends between and interconnects the lower ends of swinging frame legs 24a, 26a. Similarly, a lower cross-member extends between and interconnects the lower ends of swinging frame legs 24b and 26b. A pair of brace members, one of which is shown in FIG. 2 at 28, extend between and interconnect the cross-members at the lower ends of the swinging frame legs 24a, 24b and 26a, 26b. The lower cross-members, in combination with the brace members, support recliner 12 thereabove. If desired, the frame of recliner 12 may be bolted or screwed to the brace members, such as 28, or to the lower cross-members, to securely affix recliner 12 to the swinging frame 10.

The swinging frame legs 24a and 24b terminate in an upper apex, as do swinging frame legs 26a and 26b. A pair of bearing assemblies, such as shown in FIGS. 1 and 2 at 30, are mounted at the apices of swinging frame legs 24a, 24b and 26a, 26b. In this manner, the swinging frame 10 is pivotally mounted to upper cross-shaft 22 of the support frame 9.

Referring to FIG. 2, an electric motor 32 is mounted between support frame members 24a and 24b by a pair of brackets 34, 36. Motor 32 includes a rotatable output shaft 38 which rotates in response to operation of motor 32. A small-diameter sprocket 40 is fixed to motor output shaft 38. A drive shaft 42 is located vertically above motor output shaft 38, and is rotatably supported between support frame members 14a, 14b by means of a bearing assembly 44 (FIG. 3) connected to support frame members 14a, 14b. The opposite end of drive shaft 42 is supported by a similar bearing assembly disposed between support frame members 16a and 16b. A large-diameter sprocket 46 (FIG. 2) is fixed to drive shaft 42, and a chain 48 is trained about sprockets 40 and 46. With this arrangement, rotary power is transferred from motor output shaft 38 to drive shaft 42.

Motor 32, sprockets 40 and 46, and chain 48 are preferably enclosed within a housing, such as shown in FIGS. 1 and 3 at 50. Housing 50 includes an inner panel 52 to which a switch 54 for motor 32 is mounted. In addition, panel 52 may include an opening 56 within which a fan 58 is mounted, to cool motor 32 during its operation.

Referring to FIGS. 1 and 3, a pair of elliptical drive pulleys 60 and 62 are mounted to drive shaft 42. Elliptical pulleys 60, 62 are mounted in identical orientation relative to drive shaft 42, such that the center of driveshaft 42 is coincident with the major axis of pulleys 60, 62. Drive shaft 42 extends through an internal passage defined by elliptical pulleys 60, 62 and is secured to the inner surface of each pulley such as by welding or the like.

As shown in FIGS. 1-3, a shaft 64 extends between a pair of connector members, one of which is shown at 66. Connector member 66 secures shaft 64 at one of its ends to swinging frame leg 24a. In a similar manner, a like connector member secures the opposite end of shaft 64 to swinging frame leg 26a. With this arrangement, shaft 64 is spaced readwardly of swinging frame legs 24a and 26a. A bearing 68 (FIG. 3) is rotatably mounted to shaft 64 between a pair of circular plates 70 and 72, which are fixed in position on shaft 64. Bearing 68 is in alignment with elliptical pulley 60. A similar bearing and plate arrangement is provided on shaft 64 in alignment with elliptical pulley 62.

A resilient drive belt 74 is trained about bearing 68 and elliptical pulley 60. Similarly, drive belt 76 is trained about elliptical pulley 62 and the other bearing assembly mounted to shaft 64. Drive belts 74 and 76 are constructed of any satisfactory resilient material, such as a rubber composition, and in a prototype assembly drive belts 74, 76 have taken the form of vacuum cleaner belts. It is to be understood, however, that any satisfactory resilient material could be employed to construct drive belts 74 and 76.

In operation, the above-described components function as follows. FIG. 4 shows elliptical pulley 60 and drive belt 74 in a start-up position, in which there is no tension in drive belt 74 and swinging frame 10 hangs vertically from cross-shaft 22. In this position, the forward portion of elliptical pulley 60 remains in contact with belt 74, to prevent slippage upon start-up. When it is desired to initiate swinging of the swinging frame 10 relative to the support frame 9, the operator actuates switch 54 to begin operation of motor 32. Rotation of motor output shaft 32 is transferred through sprocket 40 and chain 48 to sprocket 46 and drive shaft 42, to cause rotation of elliptical pulleys 60 and 62. Upon rotation of elliptical pulleys 60 and 62, in either a clockwise or counterclockwise direction, pulleys 60 and 62 pull drive belts 74 and 76 forwardly, with the weight of swinging frame 10, recliner 12 and its occupant resisting such forward movement. Continued rotation of elliptical pulleys 60 and 62 imparts tension into belts 74 and 76, such as shown in FIG. 5, to pull swinging frame 10 forwardly. Upon such forward movement of swinging frame 10, tension in drive belts 74 and 76 is relieved, as shown in FIG. 6. As elliptical pulleys 60 and 62 are further rotated back toward their FIG. 4 position, the weight of swinging frame 10, recliner 12 and its occupant results in rearward movement of the swinging frame assembly. Further rotation of elliptical pulleys 60 and 62 back toward their FIG. 5 position then again pulls drive belts 74 and 76 taut to terminate the rearward movement of swinging frame 10, and then stretches belts 74 and 76 to again pull swinging frame 10 forwardly. This action repeats upon continued rotation of drive shaft 42, to impart a swinging back and forth movement to swinging frame 10.

Plates 70, 72 maintain drive belt 74 in proper lateral position and ensure that drive belt 74 remains engaged with elliptical pulley 60. The same holds true for the bearing assembly in alignment with elliptical pulley 62.

The resiliency provided by drive belts 74 and 76 eliminates jerkiness in the transition of swinging frame 10 movement from a forward direction to a rearward direction, and vice versa. As a result, it has been found that swing 10 provides extremely comfortable swinging motion, while not disturbing the occupant of recliner 12.

It is to be understood that the drive mechanism which imparts back and forth movement to the swinging frame assembly may be employed in any swing construction, and is not necessarily limited to a swing utilizing a recliner.

Various alternatives and embodiments are contemplated as being within the scope of the following claims particularly pointing out and distinctly claiming the subject matter regarded as the invention.

I claim:

1. An automated swing, comprising:

a support frame assembly;

a swinging frame assembly pivotally mounted to the support frame assembly, the swinging frame assembly being adapted to receive a seat, wherein the seat is swingable relative to the support frame assembly; and a drive arrangement interposed between the support frame assembly and the swinging frame assembly for pivoting the swinging frame assembly relative to the support frame assembly to swing the seat, comprising a resilient member engageable with the swinging frame assembly, and a reciprocable mechanism acting on the resilient member for intermittently tensioning the resilient member to engage the swinging frame assembly to pull it in a first direction, and releasing tension on the resilient member to allow the swinging frame assembly to return in a second direction.

2. The automated swing of claim 1, wherein the drive arrangement resilient member comprises a drive belt constructed of a resilient material.

3. The automated swing of claim 2, wherein the belt is engageable with the swinging frame assembly by means of a rotatable element mounted to the swinging frame assembly, with the drive belt being trained about the rotatable element.

4. The automated swing of claim 3, wherein the swinging frame assembly includes a pair of frame members terminating in an upper apex, with the swinging frame assembly being pivotally mounted to the support frame assembly at the upper apex, and wherein the rotatable element is mounted to a shaft interconnected with one of the frame members, and wherein the reciprocable mechanism is located between the frame members.

5. The automated swing of claim 2, wherein the reciprocable mechanism comprises a rotatable driveshaft, a rotary power source for imparting rotation to the driveshaft, and an eccentric drive member mounted to the driveshaft and engageable with the drive belt.

6. The automated swing of claim 5, wherein the eccentric drive element comprises an elliptical member mounted to the drive shaft.

7. The automated swing of claim 6, wherein the driveshaft extends through the elliptical member and is mounted thereto such that the center of the driveshaft is coincident with the major axis of the elliptical member.

8. The automated swing of claim 5, wherein the drive belt is engageable with the swinging frame assembly by means of a rotatable element mounted to the swinging frame assembly, wherein the drive belt is trained around and engageable with the elliptical member and the rotatable element.

9. In an automated swing comprising a support frame assembly and a swinging frame assembly mounted for pivoting movement to the support frame assembly, the swinging frame assembly having a seat mounted thereto, the improvement comprising a drive arrangement interposed between the support frame assembly and the swinging frame assembly for pivoting the swinging frame assembly relative to the support frame assembly to swing the chair, the drive arrangement comprising a resilient member engageable with the swinging frame assembly, and a reciprocable mechanism acting on the resilient member for intermittently tensioning the resilient member to engage the swinging frame assembly and to pull it in a first direction, and releasing tension on the resilient member to allow the frame assembly to return in a second direction.

10. In an automated swing comprising a support frame assembly and a swinging frame assembly mounted for pivoting movement to the support frame assembly, the swinging frame assembly having a chair mounted thereto, a method of pivoting the swinging frame assembly relative to the support frame assembly to swing the chair, comprising the steps of:

interposing a resilient member between the swinging frame assembly and the support frame assembly, the resilient member being engageable with the swinging frame assembly; and intermittently tensioning the resilient member to cause engagement of the resilient member with the swinging frame assembly to pull it in a first direction, and releasing tension on the resilient member to allow the swinging frame assembly to return in a second direction.

11. The method of claim 10, wherein the step of interposing a resilient member between the swinging frame assembly and the support frame assembly comprises interposing a resilient drive belt between the swinging frame assembly and the support frame assembly.

12. The method of claim 10, wherein the step of intermittently tensioning and releasing tension on the resilient member comprises mounting an intermittent drive arrangement to the support frame assembly, and engaging the drive belt with the intermittent drive arrangement.

13. The method of claim 12, wherein the step of mounting an intermittent drive arrangement comprises rotatably mounting a drive shaft to the support frame assembly, mounting an eccentric drive member to the drive shaft, training the resilient drive belt about the eccentric drive member and about a rotatable element connected to the swinging frame assembly, and imparting rotation to the drive shaft to intermittently tension and release tension on the resilient drive belt.

* * * * *

UNITED STATES PATENT AND TRADEMARK OFFICE

CERTIFICATE OF CORRECTION

PATENT NO. : 5,139,462

DATED : August 18, 1992

INVENTOR(S) : CURTIS GABE

It is certified that error appears in the above-identified patent and that said Letters Patent is hereby corrected as shown below:

On the Title page, item,

[56] References Cited

Please add -- 812,387, 2/1906, Wertz 1,458,049, 6/1923, Grieshaber 1,720,190, 2/1929, Anello 4,615,059, 10/1986, Darowski --

Signed and Sealed this

Seventeenth Day of August, 1993

Bruce Lehman

*Attest:*

BRUCE LEHMAN

*Attesting Officer*

*Commissioner of Patents and Trademarks*